US005490803A

United States Patent [19]

McMills et al.

[11] Patent Number: 5,490,803

[45] Date of Patent: Feb. 13, 1996

[54] COAXIAL CABLE CONNECTION METHOD AND DEVICE USING OXIDE INHIBITING SEALANT

[75] Inventors: Corey McMills, Los Altos; John Mattis, Sunnyvale, both of Calif.

[73] Assignee: Raychem Corporation, Menlo Park, Calif.

[21] Appl. No.: 335,602

[22] Filed: Nov. 8, 1994

Related U.S. Application Data

[63] Continuation of Ser. No. 981,974, Nov. 25, 1992, Pat. No. 5,362,250.

[51] Int. Cl.[6] ..... H01R 13/52

[52] U.S. Cl. ..... 439/276; 29/857; 439/936; 174/76

[58] Field of Search ..... 439/411, 936, 439/271–276, 521, 279, 281, 199; 174/76, 77 R, 138 F; 523/173; 524/506, 505; 525/479, 106, 903

[56] References Cited

U.S. PATENT DOCUMENTS

| | | | |
|---|---|---|---|
| 2,199,532 | 5/1940 | Weeks | 439/387 |
| 2,805,399 | 9/1957 | Leeper | 333/6 |
| 2,901,722 | 8/1959 | Arnot, Jr. | 439/936 |
| 3,157,735 | 11/1964 | Stroup et al. | 439/199 |
| 3,196,382 | 7/1965 | Morello, Jr. | 339/117 |
| 3,264,602 | 8/1966 | Schwartz | 339/177 |
| 3,358,264 | 12/1967 | Brejcha, Jr. | 339/177 |
| 3,492,408 | 1/1970 | Forney, Jr. et al. | 339/177 |
| 3,550,064 | 12/1970 | Caller et al. | 339/65 |
| 3,697,930 | 10/1972 | Shirey | 339/89 C |
| 3,710,004 | 1/1973 | Fench | 174/89 |
| 3,731,378 | 5/1973 | Toma et al. | 29/629 |
| 3,781,762 | 12/1973 | Quackenbush | 339/89 C |
| 3,963,321 | 6/1976 | Burger et al. | 339/177 E |
| 4,053,200 | 10/1977 | Pugner | 339/117 R |
| 4,173,385 | 11/1979 | Fenn et al. | 339/177 E |
| 4,249,790 | 2/1981 | Ito et al. | 339/177 E |
| 4,540,231 | 9/1985 | Forney, Jr. . | |
| 4,583,811 | 4/1986 | McMills | 339/117 |
| 4,600,261 | 7/1986 | Debbaut | 339/116 C |
| 4,634,207 | 1/1987 | Debbaut . | |
| 4,721,832 | 1/1988 | Toy | 174/87 |
| 4,755,152 | 7/1988 | Elliot et al. . | |
| 4,789,355 | 12/1988 | Lee | 439/584 |
| 4,806,116 | 2/1989 | Ackerman | 439/304 |
| 4,834,675 | 5/1989 | Samishisen | 439/578 |
| 4,846,721 | 7/1989 | Debruycker et al. | 439/411 |
| 4,864,725 | 9/1989 | Debbaut . | |
| 5,066,248 | 11/1991 | Gaver et al. | 439/578 |
| 5,127,853 | 7/1992 | McMills et al. | 439/578 |
| 5,226,837 | 7/1993 | Cinibulk | 439/936 |
| 5,354,210 | 10/1994 | Kobitz et al. | 523/173 |

FOREIGN PATENT DOCUMENTS

| | | |
|---|---|---|
| 0203263A2 | 12/1986 | European Pat. Off. . |
| 0226416A2 | 6/1987 | European Pat. Off. . |
| 0428424A2 | 5/1991 | European Pat. Off. . |
| 2353969 | 12/1977 | France . |
| 1565981 | 4/1966 | Germany . |
| 621459 | 4/1949 | United Kingdom . |
| 1537062 | 12/1978 | United Kingdom . |
| 2013420A | 8/1979 | United Kingdom . |

*Primary Examiner*—David L. Pirlot

*Attorney, Agent, or Firm*—Herbert G. Burkard; A. Stephen Zavell

[57] ABSTRACT

A method and a device is provided which allows the connection of coaxial cable termini to one another with minimum long-term loss of RFI shielding. The method comprises the removal of metal oxides from the concentric conductor portions of the two cable termini, applying a sealant to the concentric conductor termini and then connecting the central conductor termini to one another and the concentric conductor termini to one another. The device comprises a collet structure dimensioned to slip over the outside of a standard connection jack. Within the collet structure is disposed a quantity of sealant and the collet structure has at least one aperture through which sealant oozes from the collet structure to the exterior of the collet structure. When the collet structure is attached to the jack, the sealant is caused to ooze onto the concentric conductor thereby sealing the concentric conductor from the ambient.

5 Claims, 3 Drawing Sheets

COAXIAL CABLE CONNECTION METHOD AND DEVICE USING OXIDE INHIBITING SEALANT

This application is a continuation of application Ser. No. 981,974, filed Nov. 25, 1992 now U.S. Pat. No. 5,362,250.

UNITED STATES PATENT APPLICATIONS INCORPORATED BY REFERENCE

This application incorporates herein completely the entirety of U.S. patent application Ser. No. 07/912,106, filed Jul. 9, 1992, U.S. patent application Ser. No. 07/509,669, filed Apr. 19, 1990, U.S. patent application Ser. No. 07/434,068, filed Nov. 8, 1989, and U.S. patent application Ser. No. 07/364,917, filed Jun. 9, 1989.

FIELD OF THE INVENTION

This invention relates generally to methods and devices for connecting the termini of coaxial cables together and, specifically, to methods and devices for sealably connecting the termini of coaxial cables while minimizing radio frequency interference.

BACKGROUND OF THE INVENTION

Coaxial cable is widely used for distributing wide band radio frequency information, such as television and radio signals. The cable television/radio industry, which relies almost exclusively on coaxial cable, is one of the most rapidly expanding segments of the United States' economy. It is anticipated that in the very near future the amount and type of information available via coaxial cable networks will be greatly expanded beyond traditional television and radio signals. Coaxial cable networks may soon be the principal vehicle by which consumers obtain their daily news, access library information, do their shopping, pay their bills, and otherwise interact with much of the outside world. Maintaining and controlling the integrity of these critical coaxial cable distribution networks is a major challenge for the cable network industry.

Coaxial cable typically includes a central axial conductor and an outer conductor which is disposed concentrically around the central conductor. A low-loss, high dielectric insulation material, such as plastic foam, separates the two conductors. An outer insulating jacket is often provided over the concentric conductor to provide electrical insulation, shielding and physical protection to the cable. The concentric conductor may be a single continuous element or, more commonly, it is a composite of several layered elements of thin conductive foil, wire braid or similar material. The foil, braid or other similar material is generally made from an aluminum alloy.

Coaxial cable networks comprise lengths of cable connected to one another by connection equipment. Such connection equipment most often takes the form of a male/female connection system wherein the male member includes a connection jack and the female member includes a threaded or friction-fit coupler dimensioned to couple with the male jack. As shown in FIG. 1, a standard connection jack RG-59 cable, comprises a cylindrical, externally threaded body. For RG-59 cable the outside diameter of the jack is about 0.375 inches (0.952 cm). The outwardly projecting end of the jack is covered by a planar member which has a central aperture. Behind the aperture, within the confines of the body of the jack, is disposed an internal conductor. The body is electrically connected to one of the coaxial cable circuits and the inner conductor is connected to the other coaxial cable circuit.

The female member in the typical male/female connection system commonly comprises a jack connection moiety which is adapted to attach to the cable connection jack. The female member also comprises a cable connection moiety which physically attaches to the terminus of a coaxial cable in such a way that the cable connection moiety is in electrical contact with the concentric conductor of the coaxial cable. The cable connection moiety is adapted to allow the terminus of the central conductor to project through the center of the female member without contacting the female member, so that, when the Jack moiety is attached to the outside of the conductor jack body, the central conductor terminus protrudes into the connection jack central aperture (without contacting the jack connection moiety of the female member or the conductor jack body) and is placed into electrical contact with the internal conductor of the connection Jack. It is a basic requirement of the male/female connection system that electrical continuity is provided between the outer concentric conductors and the central conductors of joined cables while maintaining isolation between these conductors.

When all of the connections along a run of coaxial cable are properly made, the cable is largely shielded from the receipt and emission of electromagnetic radiation. This is because the outer concentric conductor carries a current which is precisely the reverse of that which is carried by the central axial conductor, so that the resulting pair of magnetic fields cancel each other out. If, however, the concentric conductor is improperly connected anywhere along the cable run, little or no reverse current will flow along that conductor and the shielding normally present in the cable run will be eliminated. Without such shielding, the signal current traveling along the central axial conductor will emit electromagnetic radiation to the atmosphere, and extraneous electromagnetic radiation from the atmosphere will be received by the central axial conductor.

Electromagnetic radiation in the radio frequency range can present at least two problems. Firstly, incoming radio frequency radiation interferes with the signal carried by the central axial conductor. Secondly, radio frequency radiation emanating from the central axial conductor interferes with other radio wave receiving equipment in the vicinity. The Federal Communications Commission (FCC) has promulgated and enforces strict regulations regarding radio frequency emission interference ("RFI").

Improper connections along concentric conductor circuits can arise for several reasons. Firstly, the connection equipment is sometimes improperly installed or a subsequent event may mechanically damage the connection equipment. Secondly, the connection termini are frequently covered by a coating of oxidation at the time of initial connection. Finally, the connection termini tend to continue to oxidize after installation. This phenomenon is especially prevalent where the concentric conductor is made from an aluminum alloy.

The prior art contains numerous methods and devices to provide long-term integrity of the outer conductor circuit. For example, methods and devices which use mechanical techniques for creating an especially strong contact between connection elements and the outer conductor have been tried. However, these methods and devices are generally expensive and usually require the use of special tools. Also, the methods are of limited value in protecting the connection points from the effects of long-term oxidation of the conductor termini by the atmosphere.

Other attempts calculated to provide the long-term connection integrity have used mechanical sealing means to seal off the connection points from the atmosphere. However, these methods usually entailed expensive and complex connection equipment. Also, such mechanical sealing means offer only limited value against the long-term diffusion of oxidizing elements into the connection area.

Finally, several attempts have been made to seal coaxial cable connections using a sealant grease or gel. However, these attempts have been found to be less than fully satisfactory, presumably because these attempts do not address the problem of initially existing oxides on the connection termini.

Therefore, there is a need for a simple and inexpensive method and device for connecting the coaxial cable termini in such a way that RFI shielding problems are minimized.

SUMMARY

The invention satisfies this need as well as many other benefits obvious to the skilled artisan.

The invention is a method for connecting the termini of two or more coaxial cables wherein the coaxial cables have a central axial conductor and at least one outer concentric conductor. The method comprises the steps of: coating the concentric conductors with an oxide abrading sealant, connecting the central axial connectors, and connecting the concentric conductors. The oxide abrading sealant is sufficient abrasive to abrade away metal oxides from the concentric conductor termini during the connection step but is not so abrasive so as to damage the thin foil and/or wire braid at the cable terminus.

Preferably the sealant is resistant to oxidation and is insoluble in water. It is also preferable that the sealant has sufficient viscosity to keep it from flowing away from the concentric conductor connection under any anticipated operating conditions.

The invention is also a coupling device for oxidatively sealing a coaxial cable to a cable port or cable splice. The coupling device comprises a cable connector having at least one connection end which contains a sealing amount of an oxide abrading sealant.

In a preferred embodiment, the coupling device is adapted to connect a coaxial cable terminus to a standard coaxial cable connection jack, wherein the connection jack comprises a body with a connection jack aperture and an internal electric conductor insulatingly disposed within the body proximate to the connection jack aperture. The device comprises:

a. an electrically conductive connection jack attachment moiety comprising a connection jack attachment moiety and a cable attachment moiety, the connection jack attachment moiety defining a collet structure having a base, a base aperture, at least one grease aperture and a plurality of flared fingers, and the cable attachment moiety having an open ended hollow cylinder which communicates with the collet base aperture, wherein the connection jack attachment moiety is dimensioned to attach snugly around the body of the connection jack and the cable attachment moiety is dimensioned to electrically and shieldingly attach to the cable attachment moiety while with the concentric conductor axially through the collet base aperture, through the connection jack aperture, and into electrical contact with the internal electrical conductor;

b. a hollow, open-ended swagging shell disposed around the connection jack attachment moiety and comprising a compression moiety and a retraction moiety, the compression moiety being dimensioned to tightly surround the flared fingers of the connection jack connector so as to apply hoop stress thereto and so as to urge the flared fingers into tight connection with the body of a connection jack attached to the terminus of the cable;

c. a sealing quantity of sealant disposed within the collet structure; preferably the quantity of sealant being sufficient to fill at least about 40 percent of the volume defined by the collet structure; and d. removable cover means for cooperating with the collet structure to substantially encapsulate the quantity of sealant.

Preferably each of the flared fingers in the connection jack connection moiety has a sealant aperture. It is also preferable that the slits between the flared fingers be covered by a thin, flexible webbing.

In one embodiment, the removable cover means comprises a cap having an end cover and a cylindrical body. Preferably the cylindrical body has sufficient length to seal the slits between the flared fingers of the collet structure. Also preferably, the removable cover is adapted to interlock with the collet structure in such a way that the cap cannot be rotated about the cable terminus independent of the collet structure. This preferred embodiment of the cap allows the cap to be used as a "wrench" to make it easy for a user to install the connection jack attachment moiety to the cable terminus.

The invention provides for the first time a simple and inexpensive method for ensuring RFI shielding of a coaxial cable run, even after years of use in outdoor service. The method of the invention is easy to apply and the device of the invention is inexpensive and simple and easy to use. An additional benefit of the invention permits retrofitting onto existing coaxial cable runs without special tools or equipment.

DESCRIPTION OF THE DRAWINGS

These and other features, aspects and advantages of the present invention will become understood with reference to the following description, appended claims and accompanying illustrative drawings, where:

FIG. **5*a* is an end view of a connection jack connector having web between the flared fingers.

DESCRIPTION

Figure 1:
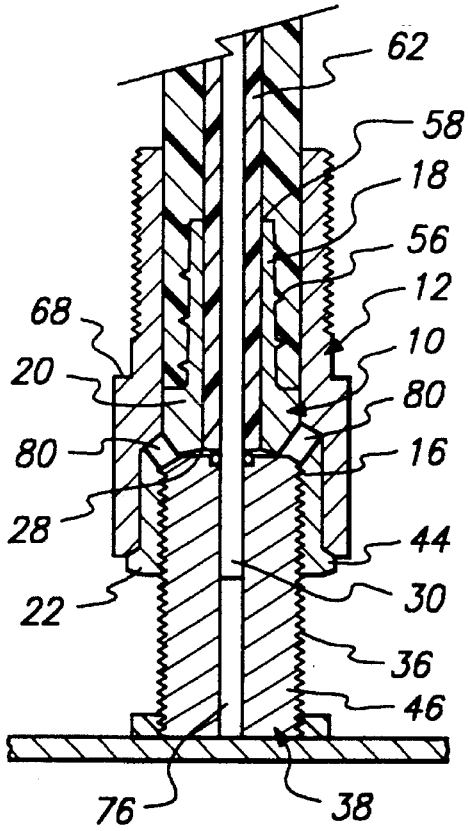
FIG. 1 is a cross-sectional view of a coaxial cable connection system having features of the invention.
Figure 2:
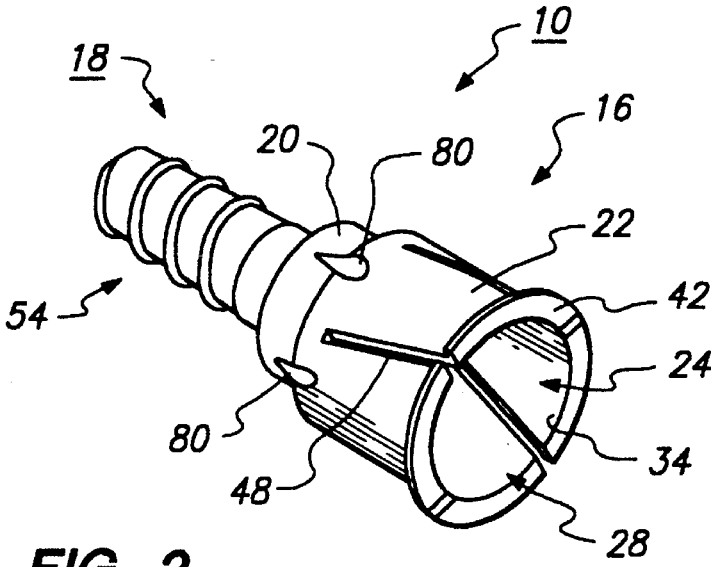
FIG. 2 is a prospective view of a connection jack connector having features of the invention.
Figure 3:
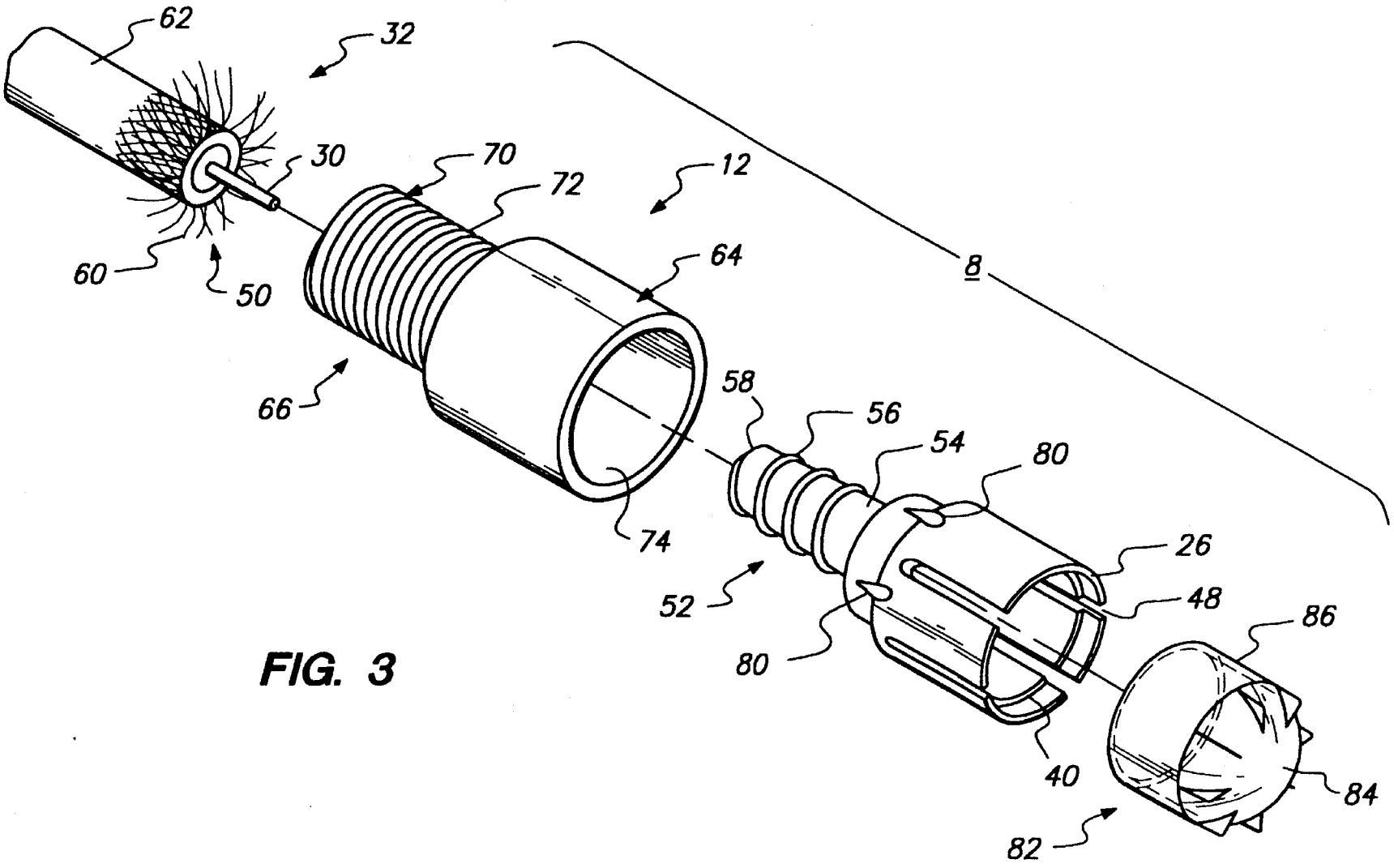
FIG. 3 is a prospective view of an assemblage having features of the invention.
Figure 4:
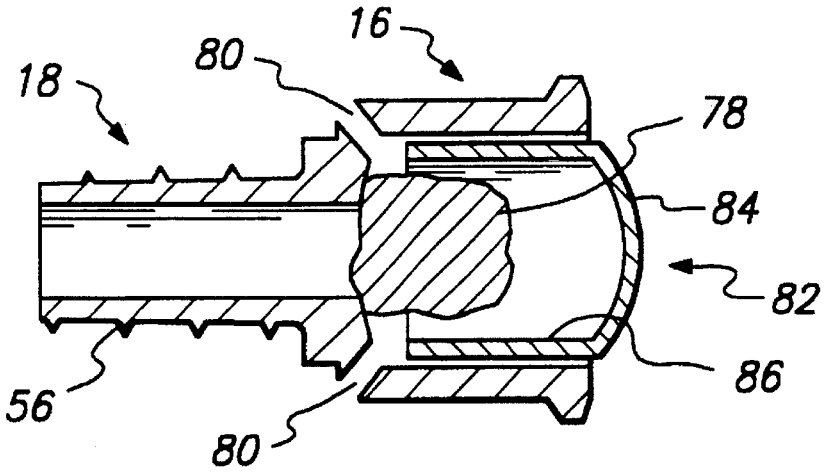
FIG. 4 is a cross-sectional view of a second connective jack connector having features of the invention.

The invention is a method for connecting the termini of two or more coaxial cables wherein the coaxial cables each have a central axial conductor and an outer concentric conductor. The method comprises the steps of coating each of the concentric conductors with a sealing amount of an oxide abrading sealant, connecting the central conductors to one another, and connecting the concentric conductors to one another. Optionally, before the central conductors are connected to one another, they are also coated with the sealant.

The sealant is sufficiently abrasive to remove oxides from the concentric and central conductors. However, the sealant is not so abrasive so as to substantially damage the thin foil and/or wire braid in the concentric conductor.

The sealant base material can be prepared from a wide variety of organic and inorganic oils, greases and waxes. A suitable sealant is a vegetable oil based grease distributed by Blackburn, Division of FL Industries, Inc. of St. Louis, Mo. under the name "8-3 Contax." Another material which has been found suitable as a sealant is a mixture of about 20% oil and about 80% wax.

An abrasive material is added to the sealant base material. In one embodiment, glass beads having a diameter range between about 0.00001 inches (0.0000254 cm) and about 0.002 inches (0.00508 cm) are added into the sealant. Preferably the diameters of the glass beads are between about 0.0003 inches (0.000762 cm) and about 0.0008 inches (0.002032 cm) in diameter. Other dielectric materials besides glass may also be used, such as sand or silica. Also, the abrasive material need not be spherical. For example, glass fibers could be used as the abrasive material.

The sealant is preferably chemically resistent to elements present in the ambient environment. The sealant should be resistant to oxygen penetration. The sealant should also be resistant to air pollutants and to organic degradants. The sealant is also preferably insoluble in water and in all other liquids which may contact concentric conductor connection.

It is important that the sealant be sufficiently viscous to prevent slumping and flowing under service conditions. Preferably the viscosity of the sealant at about 68° Fahrenheit (20° Celsius) is at least about 1,000 cps. At about 150° Fahrenheit (66° Celsius) is also preferable that the viscosity of the sealant be at least about 500 cps. The sealant should not, however, be so viscous so that it cannot be easily displaced during the connection procedure or at low temperatures. Ideally, the viscosity of the sealant at about 68° (20° Celsius) Fahrenheit is between about 2,000 cps and about 50,000 cps, and at about 150° Fahrenheit (66° Celsius), between about 500 cps and about 1,000 cps.

As shown in the drawings, the invention is also a coupling device 8 useful in the connection of a coaxial cable terminus 32 to a standard coaxial cable connection jack 38 using the method of the invention. As used herein, the phrase "standard connection jack" refers to that most common connection jack having (1) a body 46 with a connection jack aperture 76 and (2) an internal electrical conductor disposed within, but insulated from the connection jack body proximate to the connection jack aperture 76.

The coupling device 8 comprises a connection jack connector 10, a hollow swagging shell 12, a quantity of sealant 78 and removable cover means to substantially encapsulate the quantity of sealant 78.

The connection jack connector 10 comprises two connection ends, a connection jack attachment moiety 16 and a cable attachment moiety 18. The connection jack attachment moiety 16 has a collet structure with a collet base 20 and a plurality of flared fingers 22 which extend outwardly from the base 20 to form a collet attachment cup 24 having a peripheral edge 26.

The collet base 20 defines a central aperture 28 dimensioned to allow the central conductor 30 of a coaxial cable terminus 32 to protrude through the collet base 20 into the collet cup 24 without making electrical contact with the connection jack connector structure. A typical circular central aperture 28 has a diameter between about 0.15 and about 0.30 inches.

The fingers 22 define the collet cup 24 and provide an inside cylindrical engagement surface 34 suitable for engaging the outer threaded surface 36 of a connection jack 38. The inside surface 34 of the fingers 22 may be smooth or it may be provided with a shallow-cut helical groove, thread or ridge 40. Preferably, each finger can have a ridge 40 running laterally across the width of each finger 22. The pitch of the ridge 40 is set to correspond with the thread pitch of the jack 38. In embodiments having the ridge 40, a more positive attachment can be achieved between the connection jack connector 10 and the connection jack 38.

Preferably, each finger 22 is formed with a thickened region 44 adjacent to the chamfer 42 and becomes gradually thinned toward its connection with the collet base 20. The inside geometry of the collet cup 24 is generally cylindrical when in an unstressed, uncompressed state. When in such unstressed, uncompressed state, the collet cup 24 defines a slightly curved or frustroconical geometry. This allows the connection jack attachment moiety 16 to be easily slipped over the outside surface 36 of the connection jack body 46.

The collet cup 24 is dimensioned so that, in its unstressed state, it can be easily slipped over the outer surface of a connection jack body 46 but, when hoop stress is applied to the external surface of the fingers 22, the connection jack attachment moiety 16 can be tightly connected around the body 46 of a connection jack 38.

In a preferred embodiment to be used with a jack having an outside diameter of 0.375 inches (0.952 cm), the collet structure comprises four fingers 22, each defining a quadrant of a cylinder having an inside diameter between about 0.37 inches (0.940 cm) and about 0.38 inches (0.965 cm). Each finger is between about 0.2 inches (0.508 cm) and about 0.5 inches (1.270 cm) long. Each finger 22 is separated from an adjacent finger by a longitudinal slit 48 which can be between about 0.01 inches (0.0254 cm) and about 0.1 inches (0.254 cm) wide, preferably between about 0.04 inches (0.101 cm) and about 0.05 inches (1.270 cm) wide. The fingers 22 may be formed by cross-sawing across the collet structure at right angles. Alternatively, and preferably for mass production, the fingers 22 are formed by a single machining operation of two parallel saws which move in one direction across the collet structure.

Figure 5A:
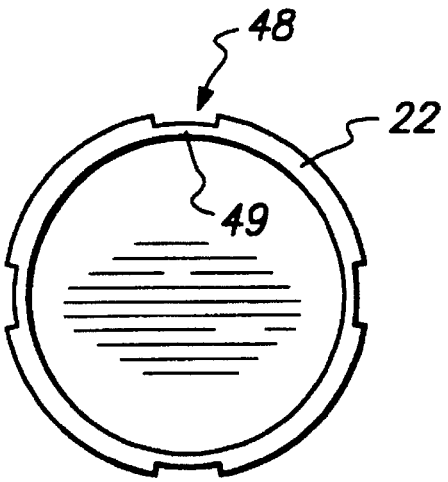
FIG. 5*b*** is an end view of a connection jack connector having an external sleeve to create a web between the flared fingers.
Figure 5B:
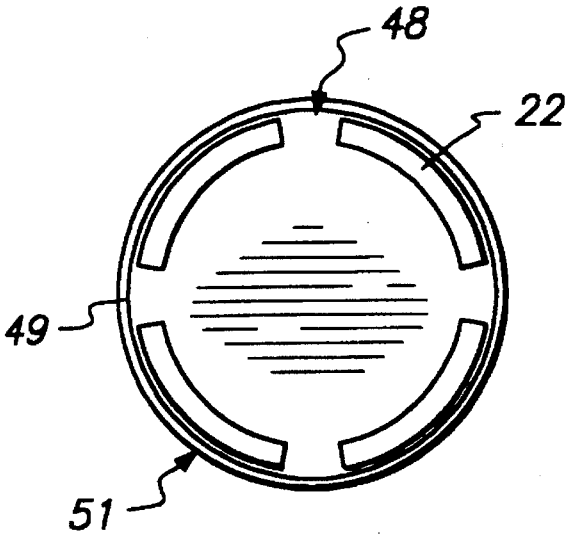

In a most preferred embodiment, the longitudinal slits 48 between the fingers 22 is covered Or filled with a thin flexible web 49. The web 49 is sufficiently flexible so as to be readily deformed when hoop stress is applied to the collet structure. The web 49 can be any suitable material having sufficient flexibility. The web 49 can be a thin sleeve 51 disposed over the collet structure as shown in FIG. 5*b*. For efficiency of manufacture, the web 49 is integral with the finger 48 as shown in FIG. 5*a*. It has been found that the use of a web 49 improves the distribution and abrasive action of the sealant during installation by not allowing the sealant to be extruded out through the slits 48.

The connection jack connector 10 further comprises a cable attachment moiety 18. The cable attachment moiety 18 is physically attached to the connection jack attachment moiety 10 proximate to the collet base 20. The cable attachment moiety 18 is also adapted to attach to the coaxial cable terminus 32 in such a way that the cable attachment moiety 18 is in electrical contact with the concentric conductor 50 of the cable terminus 32 while the central conductor 30 is caused to protrude axially through the collet base aperture 28 and into the center of the collet cup 24.

The cable attachment moiety 18 can be any of the standard crimp-on varieties commonly known in the industry. The cable attachment moiety 18 can also be one of the several types disclosed in U.S. patent application Ser. No. 07/364,917, which is completely incorporated herein by reference for all purposes.

Preferably, however, the cable attachment moiety 18 is a screw mandrel 52 having (1) a cylindrical mandrel element 54 and, (2) a helical knife-blade ridge 56 which forms a screw thread defined on the exterior of the mandrel element 54. The mandrel element 54 is generally cylindrical having an outside diameter chosen for use with the size of the cable outside diameter with which it is to be used. For RG59 cable, the preferred outside diameter of the mandrel element 54 is between about 0.20 and about 0.21 inches. Preferably, the mandrel element 54 is slightly frustroconical for ease of insertion. Also, in a typical embodiment, the portion of the mandrel element 54 distal from the collet base 20 is thinned to provide a sharp rearward opening 58. The helical knife-blade ridge 56 has a height which is between about 0.02 inches (0.0508 cm) and about 0.06 inches (0.152 cm), preferably between 0.038 inches (0.0965 cm) and 0.042 inches (0.107 cm), and is formed as a acutely angled projection extending from the mandrel element 54. In a preferred embodiment, the "threads" which are formed by knife-edge ridge 56 are 60° angle threads and are disposed at about 8 to about 16 threads per inch, preferably between about 11 to about 13 threads per inch (about 4 to 5 threads per centimeter).

The helical knife-blade ridge 56 is shaped so as to bite sufficiently into the metal braid 60 which forms the concentric conductor 50 in most coaxial cable. Such a helical knife-blade ridge 56 has also been shown to provide a secure mechanical attachment to the coaxial cable terminus 32 without causing the metallic strands which form the braided concentric conductor 50 to shear or break off. An effective compromise between sharpness and dullness of the knife-blade edge ridge 56 is to make it flat across for about two to three mils. A one mil flat is too sharp and will result in shearing the fine wire braid 60, while an eight-mil radius at the edge has been found to be too dull with resultant slippage of the braid under tension. Ideally, the knife-blade ridge 56 should subject the braid wires to shear stresses without actually resulting in shearing.

The use of a helical knife-blade ridge 56 on the cable attachment moiety 18 of the connection jack connector 10 has been found to be particularly advantageous in order to facilitate easy insulation of the connection jack connector 10 onto the coaxial cable 62, especially at low ambient temperatures.

The connection jack connector 10 is made from an electrically conductive material, usually a metal. Aluminum is a highly preferred such metal because it is light weight, inexpensive and highly conductive. Where the cable attachment moiety 18 comprises a screw mandrel 52 and the cable attachment moiety 18 is made from aluminum, another conductive material, such as a tin alloy, is preferably applied to the exterior of the mandrel element 54 to provide additional lubricity to the exterior of the mandrel element 54 and to facilitate the insertion of the mandrel element 54 into the coaxial cable terminus 32.

The swagging shell 12 has an open-ended hollow tubular shape. The swagging shell 12 has a compression moiety 64 and a retraction moiety 66. The compression moiety 64 is adapted to apply hoop stress to the exterior of the collet fingers 22 on the connection jack connector 10 and the retraction moiety 66 is adapted to interface with one or more tools adapted to drive the swagging shell 12 over the collet fingers 22 and/or, alternatively, to retract the compression moiety 64 off of, and away from, the collet fingers 22.

The compression moiety 64 is generally cylindrical and is dimensioned to be slidable over the collet fingers 22 in such a way as to impart considerable hoop stress to the collet fingers 22, thereby causing the collet fingers 22 to tightly grip the exterior surface 36 of the connection jack body 46. For a standard jack having an outside diameter of about 0.375 inches (0.95 cm), the inside diameter of the compression moiety 64 is typically between about 0.40 inches (1.02 cm) and about 0.42 inches (1.07 cm), preferably between about 0.41 inches (1.04 cm) and 0.415 inches (1.054 cm).

The retraction moiety 66 of the swagging cylinder 12 is also typically cylindrical. It is attached to the compression moiety 64 in such a way that the longitudinal axes of the compression moiety 64 and the retraction moiety 66 are coaxial. The inside diameter of the compression moiety 64 is dimensioned to allow the retraction moiety 66 to slip freely along the outside of the coaxial cable 62. In a preferred embodiment, the outside diameter of the retraction moiety 66 is dimensioned to be slightly smaller than the outside diameter of the compression moiety 64 so that an annular shoulder 68 is formed at the interface of the retraction moiety 66 and the compression moiety 64. In a typical embodiment, the annular shoulder 68 is between about 0.10 inches (0.254 cm) and about 0.20 inches (0.51 cm) in width. Such annular shoulder 68 provides a surface against which an axial force can be applied so as to urge the swagging shell 12 over the collet fingers 22.

In another preferred embodiment, the exterior surface 70 of the retraction moiety 66 is provided with indentations, ridges or other structure capable of providing a surface against which a force can be applied to the swagging shell 12 to urge the swagging shell 12 off of the collet fingers 22. In a most preferred embodiment, such structure is provided by external screw threads 72.

The swagging shell 12 is made from a rigid material capable of withstanding the pressures and wear and tear resulting from its interaction with the collet fingers 22 and with various driving and retraction tools. Typically, the swagging shell 12 is made from a metal, such as a brass, an aluminum or a steel.

Where the connection jack connector 10 comprises a mandrel element 54 which is physically inserted into the coaxial cable terminus 32 (such as the screw mandrel 52 described above), the swagging shell 12 is preferably constructed so that the internal diameter of the retraction moiety 66 is smaller than the internal diameter of the compression moiety 64, and the interior surface 74 of the swagging shell 12 at the interface between the retraction moiety 66 and the compression moiety 64 is beveled. Also, the internal diameter of the retraction moiety 66 can be dimensioned so as to apply a compressive force to the exterior of the cable terminus 52 in the region of the terminus 52 wherein has been inserted a connection jack connector 10 having a mandrel-type connection jack attachment moiety 18. In such an embodiment, the inside diameter of the retraction moiety 66 is dimensioned to be about the same or only slightly larger than the outside diameter of the cable terminus 32 after insertion of the mandrel element 54. Such a swagging shell 12 can be used to apply compressive force to the exterior of a coaxial cable terminus 52 having inserted therein a cable attachment moiety 18 comprising a mandrel element 54. Such compressive force is effective in securing and maintaining a positive electrical connection between the concentric conductor 30 of the coaxial cable 62 and the mandrel element 54 of the connection jack connector cable attachment moiety 18.

In a preferred method of installing a connection jack connector 10 having a mandrel element 54 to the coaxial cable terminus 32, strands of the metal braid 60 which form the concentric conductor 50, are disposed around the exterior of the collet fingers 22 and are held fast against the fingers 22 by the compression moiety 16 of the swagging shell 12. This installation method has been found to provide a superior electrical connection between the cable attachment moiety 18 of the connection jack connector 10 and the concentric conductor 50, a connection which will not fail even after numerous temperature cycles.

FIG. 1 illustrates how the swagging shell 12 compresses the connection jack connector 10 to form a tight connection with the cable terminus 32 and the connection jack 38.

Sealants useful in the device have been described above. In a preferred embodiment the quantity of sealant is sufficient to fill at least about fifty percent of the volume defined by the collet structure, most preferably at least about sixty percent.

Preferably the connection jack attachment moiety 16 has a plurality of sealant apertures 80. In a typical embodiment, each of the flared fingers 22 has one sealant aperture 80 defined near the collet base 20. Typically the sealant aperture 80 is round and has a diameter between about 0.3 inches (0.76 cm) and about 0.4 inches (1.02 cm), preferably about 0.325 inches (0.826 cm) and about 0.363 inches (0.922 cm).

As shown in the drawings, the removable cover means can comprise a cap 82 having an end cover 84 and a cylindrical body 86. Preferably the cylindrical body 86 has sufficient length to seal the slits 48 between the flared fingers 22 of the collet structure.

In another preferred embodiment, the removable cover means interlocks with the collet structure in such a way that the removable cover means cannot be rotated above the cable terminus 32 independent of the collet structure. In this embodiment, the removable cover means can be used as a "wrench" to turn the collet structure with respect to the cable terminus 32. This is an important feature of the connection device in embodiments having a threaded mandrel 52 which is screwed and unscrewed into the cable terminus 32. Where the removable cover means interlocks with the collet structure, the removable cover means can be easily employed by the user to thread the mandrel 52 into the terminus 32 without the need of any kind of tool.

Using the device described above, the method of the invention can be employed to connect a coaxial terminus to a standard connection jack 38 by the steps of attaching the electrically conductive connection jack connector 10 to the terminus 38 of the cable 62, placing the connection jack connector 38 over the connection jack 10, and sliding the swagging shell 12 over the flared fingers 22 of the connection jack connector 38.

It has been found that the mere placing of the connection jack connector 10 over the connection jack 38 causes the sealant to not only ooze rearwardly out of the sealant aperture(s) 80, but also to ooze out of the slits 48 between the flared fingers 22 and out of the rearward opening 58 of the cable attachment moiety 18. This action causes sealant 78 to thoroughly coat under, over and throughout the concentric conductor terminus, and on the inside and outside surfaces of the cable attachment moiety 18. Thus, the entirety of the concentric conductor terminus is thoroughly coated with the sealant 78 and is thereby protected from oxidation.

The foregoing describes in detail several preferred embodiments of the invention. The foregoing should not be construed, however, as limiting the invention to the particular embodiments describes. Practitioners skilled in the art will recognize numerous other embodiments as well. For a definition of the complete scope of the invention, the reader is directed to the appended claims.

What is claimed is:

1. A method of connecting the termini of two or more coaxial cables wherein the coaxial cables each have a central axial conductor and an outer concentric conductor, the method comprising the steps of:

(a) coating each of the concentric conductors with an oxide abrasive sealant, the sealant has a viscosity at 68° F. of at least about 1000 cps and includes beads selected from the group consisting of glass, sand, silica, or mixtures thereof and wherein the beads have a diameter range between about 0.00001 inches to about 0.002 inches;

(b) connecting the central conductors to one another; and (c) connecting the concentric conductors to one another; wherein the sealant is sufficiently abrasive to remove oxides from the conductors but not so abrasive so as to do significant damage to the conductors.

2. The method of claim 1 wherein the sealant has a viscosity at 150 degrees Fahrenheit of at least about 500 cps.

3. The device of claim 1 wherein the sealant comprises beads having diameters between about 0.0001 inches and about 0.002 inches.

4. A coupling device for oxidatively sealing a coaxial cable to a cable port or cable splice, the device comprising a cable connector having at least one connection end containing a sealing amount of an oxide abradding sealant, the sealant is resistant to oxidation, is insoluble in water and has a viscosity at 68° F. between about 1,000 cps and about 100,000 cps and includes beads selected from the group consisting of glass, sand, silica, or mixtures thereof having diameters between about 0.00001 inches and about 0.002 inches.

5. The device of claim 4 wherein the sealant comprises beads having diameters between about 0.0001 inches and about 0.002 inches.

* * * * *